United States Patent [19]

Grünewald et al.

[11] 4,325,284

[45] Apr. 20, 1982

[54] TRUNNION BEARING IN ARMORED HOUSING

[75] Inventors: Peter Grünewald, Fuldabrück; Uwe Sprafke, Kassel, both of Fed. Rep. of Germany

[73] Assignee: Wegman & Co. GmbH, Kassel, Fed. Rep. of Germany

[21] Appl. No.: 744,948

[22] Filed: Nov. 19, 1976

[30] Foreign Application Priority Data

Nov. 20, 1975 [DE] Fed. Rep. of Germany ..... 2552009

[51] Int. Cl.[3] ..... F41F 23/06

[52] U.S. Cl. ..... 89/37 E

[58] Field of Search ..... 89/36 K, 36 L, 37 E

[56] References Cited

U.S. PATENT DOCUMENTS 3,854,377 12/1974 Schiele ..... 89/37 E

*Primary Examiner*—Stephen C. Bentley

*Attorney, Agent, or Firm*—L. Lawton Rogers, III

[57] ABSTRACT

A gun barrel mount for a battletank in which the gun barrel and its cradle roller may be horizontally inserted into a relatively small aperture in the armor of the battletank turret and maintained in that position with a few threaded fasteners, the entire assembly being easily removable for replacement and/or repair. Insertion of the gun assembly into the turret horizontally obviates the need to separate the turret armor vertically which weakens the armor.

2 Claims, 3 Drawing Figures

TRUNNION BEARING IN ARMORED HOUSING

Figure 1:
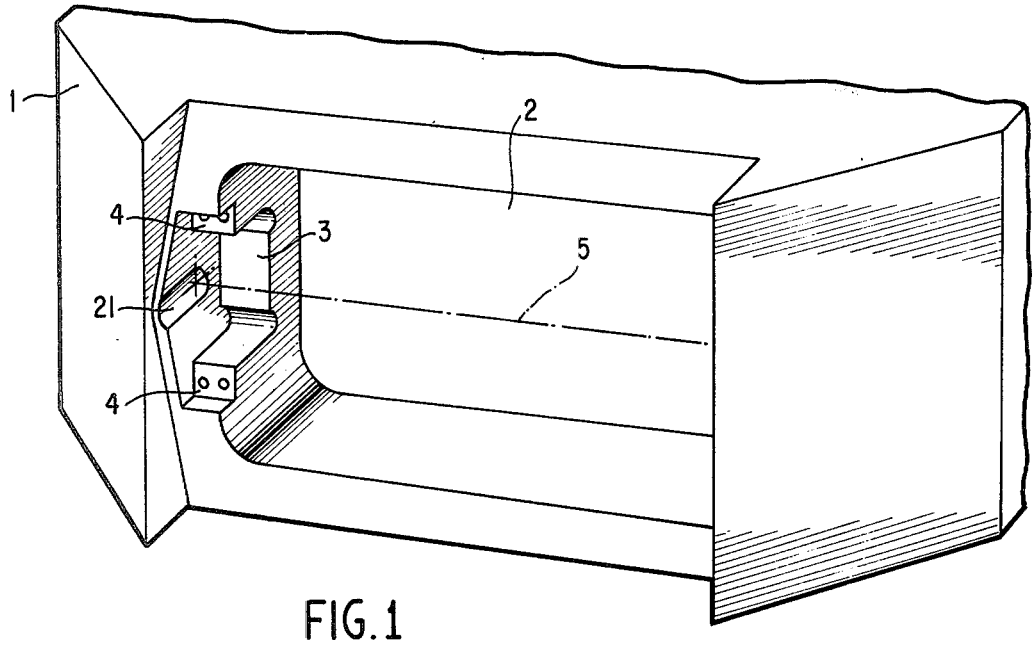

The invention concerns a trunnion bearing in armored housing especially in main battletanks. The trunnion bearing of gun barrels causes considerble difficulties because, in order to achieve as great as possible a field of sluing in elevation, this trunnion bearing should be located in the armor and, at the same time, however, the ballistic protection of the housing should not be lessened. In the case of well-known trunnion bearings, the bearings are pushed in from the outside through boreholes over the trunnions of the gun mounting. In this case, it is necessary for the two boreholes to be located very accurately on a coaxial basis. This causes high demands in the manufacture of the boreholes and, in certain circumstances, the shape of the housing does not allow this solution. Consistent with another well-known solution, instead of boreholes, bolts are shrunk into the armor and on which the bearing is slid and subsequently the connection with the gun barrel is produced by means of bearing brass. In addition, it is, however, necessary for the opening in the armor to be essentially wider than would be required by itself for the leadin of the gun barrel. Repairs are difficult since the shrunk-in bolts can only be exchanged at great cost.

Consistent with the invention, all of these disadvantages of the well-known trunnion bearings are avoided in that recesses are provided on the outside of the housing on both sides of the opening used for installation of the weapon. Into these recesses it is possible to insert from the front the trunnions of the weapon together with the bearing rings suspended on the trunnions. At the same time, the somewhat U-shaped recesses appropriately each feature two shoulders which are used as supports on the bearing rings for each two lugs. These lugs are connectable by screws with the shoulders of the recess. Application of the invention results in the advantage that the gun barrel can be inserted together with the bearings and for attachment only a few screws have to be tightened so that the gun barrel can be taken out at any time without difficulty. The opening in the armored housing for installation of the gun barrel can at the same time be constructed quite narrow without the cross section required by the gun being adversely affected. No high requirements are to be placed on the accuracy of the recesses and the shoulders used as supports since inaccuracy and bearing play can be easily compensated for or adjusted in an axial and radial direction. For this reason, adjusting rings can be screwed on more particularly on two bearing rings or at least on one of the two bearing rings. The adjusting rings can be screwed out after insertion of the weapon in the direction against the sidewalls of the opening and thereby compensate for axial play. An adjustment in the radial direction can be accomplished simply, for example by the insertion of adjusting pieces.

Further, both trunnions or at least one of the trunnions can have an axial borehole for installation of an angle drive component. For fine adjustment, it is possible to install an adjusting arm on the shaft of the angle drive component.

A form of construction of a trunnion bearing consistent with the invention is depicted in the figures.

FIG. 1 shows perspectively one part of the armored housing with the installation opening for the gun barrel.

Figure 2:
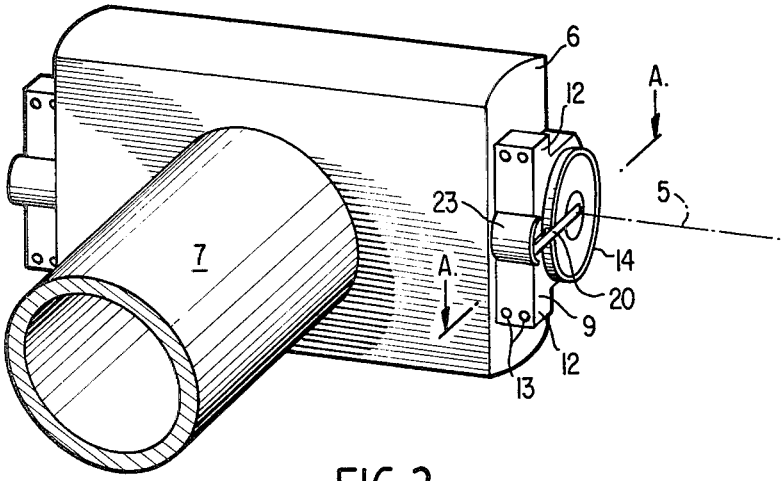

FIG. 2 likewise shows in perspective representation the bearing part to be inserted into this installation opening. Part of bearing also shown with part of the gun barrel.

Figure 3:
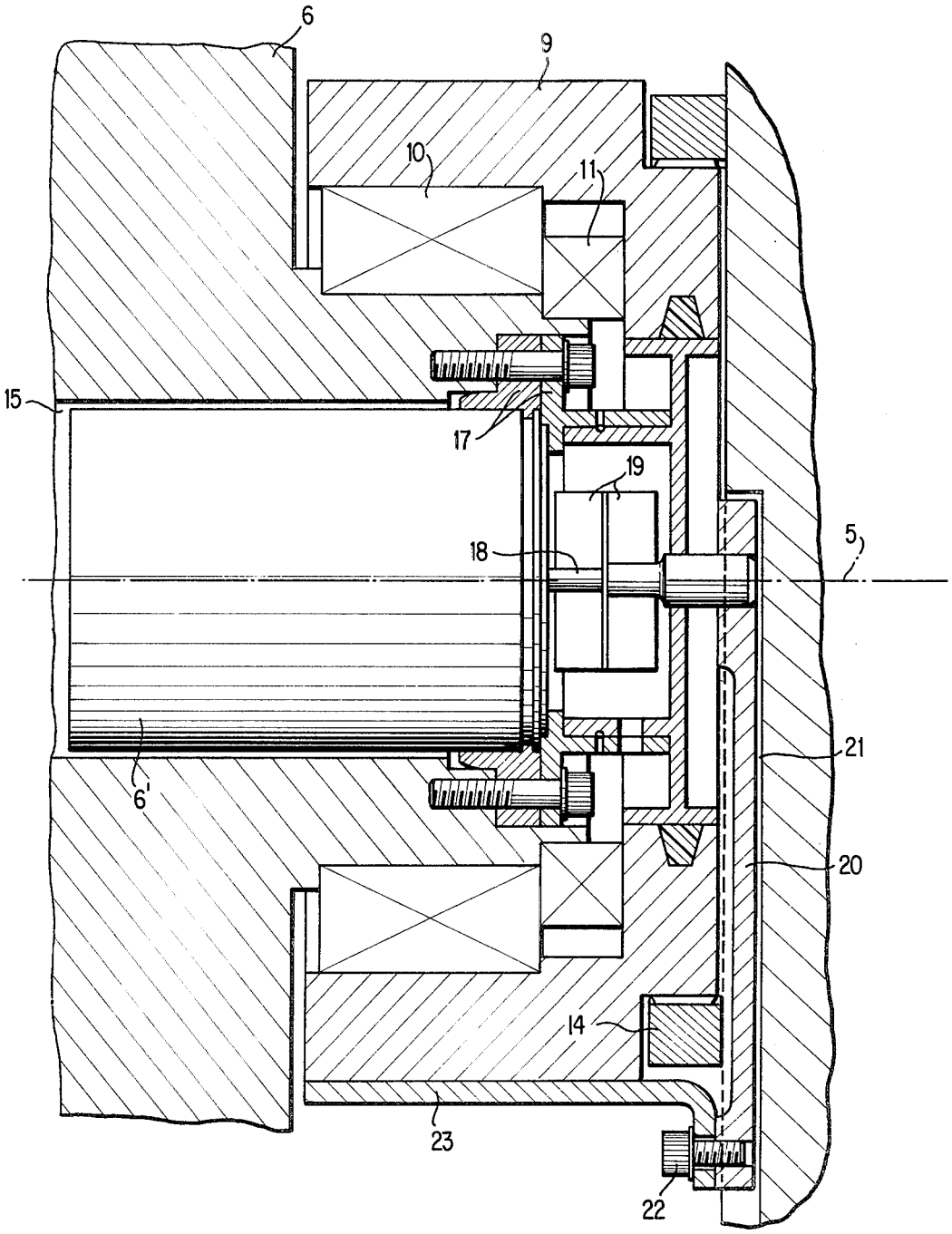

FIG. 3 shows in magnification a cross section according to line A—A in FIG. 2.

The armored housing 1 has a window-like opening 2 whose both sidewalls are provided with approximately U-shaped recessed 3 open to the outside. These recesses have shoulders 4 with thread borings for installation of fastening screws. The gun tube bearing to be inserted into this installation opening consists of a cradle roller 6 through which gun barrel 7 is passed. This cradle roller features one trunnion 8 on both sides. Bearing rings 9 are suspended on both lugs 12 which are provided with boreholes 13 for installation of fastening screws. The whole arrangement depicted in FIG. 2 can be inserted from the front into the installation window 2 of the armor where the fastening also takes place by means of screws which are screwed in through boreholes 13 into the threaded boreholes of shoulders 4. For removal of axial play, adjusting rings 14 are suspended on at least one of the two bearing rings, more appropriately on both bearing rings. These adjusting rings are appropriately fabricated as slotted nuts so that they can be tightened firmly by means of a tool and place axial bearing 11 under stress such that axial play is removed.

The trunnion 8 has at least on one side an axial borehole 15 in which an angle drive component, for example an electrical angle transmitter, 16, can be inserted. The angle drive component is flanged to the trunnion by means of rings 17. In order to enable a fine adjustment of the angle drive component, the rotor drive shaft 18 of the angle drive component is connected with an adjusting lever 20 through a coupling 19. This adjusting lever is passed to the outside through a nut 21 provided in the recess 3. After fine adjustment of the angle drive component, the adjusting lever 20 can be attached by means of screw 22 to a cover plate 23 which is attached on the outer side of bearing rings 9. By this attachment of the angle drive component directly in the elevation axis 5 of the gun, additional elements transmitting the rotation such as rods or drives are avoided with the errors in angle drive conditioned by them. The whole arrangement can be shielded to the outside by an armor plate not portrayed in the figures. For improvement of armor protection, the bearing rings 9 can be made of armor steel. Repairs can easily be carried out because the gun barrel can be taken out from the tank housing to the front with the entire trunnion bearings after loosening the attachment screws so that all individual parts such as, for example, the axial needle bearings or the radial roller bearings, or the angle drive components can be reconditioned or exchanged. Further, the new trunnion bearing has the great advantage that it can be subsequently attached to already available tank housing with another trunnion bearing. For this purpose, all that is necessary is to incorporate the recesses 3 with shoulders 4 into the opening 2 of the housing whereupon a weapon such as shown in FIG. 2 can be inserted. Thereby, it is possible for a larger weapon to be inserted in certain circumstances into an available armored vehicle since, in the case of the trunnion bearing consistent with the invention, the window-type opening in the tank housing can feature a lesser width than in the case of the well-known trunnion bearings.

I claim:

1. A battletank turret having an aperture for receiving a gun barrel mount from the outside of the turret without vertical separation of the turret comprising:

a cradle roller for receiving a gun barrel, said cradle roller having a trunnion laterally extending from opposite sides thereof;

a bearing ring carried by each of said trunnions, each of said bearing rings having an upwardly extending lug and a downwardly extending lug on the gun muzzle side of said cradle roller, said lugs being apertured to receive fastening means, and being adapted for support by cooperating shoulders on a pair of generally U-shaped recesses open to the outside of the turret in the side walls defining the aperture in the turret;

fastening means extending through the apertures in said lugs into said cooperating shoulders at the gun breech end of said generally U-shaped recesses to thereby secure said bearing ring and thus said cradle mount to the turret; and means for adjusting the play between said cradle mount and the turret whereby a gun and its cradle roller may be inserted in a general horizontal direction into an aperture in the turret without the vertical separation of the turret.

2. A main battletank turret with a window-type opening on the front side for receiving a gun barrel mount, the outside of the main battletank turret including essentially U-shaped recesses on both sides of said window-type opening;

a gun barrel;

a gun barrel mount through which said gun barrel is passed, said gun barrel having a cradle roller on whose two side surfaces a trunnion is carried;

a bearing ring and bracket suspended on each of said trunnions, said trunnions being suspendable from the front of the battletank by means of said bearing rings;

a lug, carried by each one of said two bearing rings and supported by two shoulders of each of said recesses, said lugs being connectable by bolts with said shoulders;

an adjusting ring carried by a least one of said bearing rings; and, an elevation angle transmitting means including a rotor shaft coupled to a fine adjustment adjusting arm through a slot provided in the said U-shaped recess to the bracket of said bearing ring, at least one of said trunnions having an axial bore for receiving said elevation angle transmitting means.

* * * * *